United States Patent [19]

Wagner

[11] 4,019,609

[45] Apr. 26, 1977

[54] BRAKE APPARATUS FOR USE IN RAPPELLING

[76] Inventor: Kelly B. Wagner, 14510 SE. Woodland Way, Milwaukie, Oreg. 97222

[22] Filed: Nov. 3, 1975

[21] Appl. No.: 628,068

[52] U.S. Cl. ..... 188/65.4; 24/136 R; 24/194; 182/5

[51] Int. Cl.[2] ..... B65H 59/14

[58] Field of Search ..... 188/65.1, 65.2, 65.3, 188/65.4, 65.5; 182/5, 6, 7, 191, 192, 193; 24/115 G, 136 R, 136 K, 171, 194, 196

[56] References Cited

UNITED STATES PATENTS

| | | | |
|---|---|---|---|
| 507,455 | 10/1893 | Sansoucy | 182/5 |
| 732,368 | 6/1903 | Mitchell | 24/194 |
| 2,290,135 | 7/1942 | White | 24/194 |
| 3,678,543 | 7/1972 | Hobbs | 24/115 R |
| 3,695,397 | 10/1972 | Hobbs | 188/65.4 |
| 3,757,901 | 9/1973 | Hobbs | 188/65.4 |

*Primary Examiner*—Trygve M. Blix
*Assistant Examiner*—Edward R. Kazenske
*Attorney, Agent, or Firm*—Chernoff & Vilhauer

[57] ABSTRACT

An apparatus and method for braking a mountain climber's descent while rappelling. A unique brake bar is provided which permits the use of two carabiners adjacent one another in a braking apparatus for attachment to a supporting rope thereby providing increased strength, redundancy and great braking effectiveness. Due to its novel shape comprising an elongate body provided with an oblong aperture at each end, the brake bar is adapted to readily accept the two carabiners simultaneously and, in particular, the configuration of the oblong apertures minimizes the possibility of the accidental release of the carabiners, thereby increasing the ease and safety of rappelling.

5 Claims, 3 Drawing Figures

BRAKE APPARATUS FOR USE IN RAPPELLING

BACKGROUND OF THE INVENTION

This invention relates to mountain climbing equipment and techniques, and more particularly, to apparatus and methods for braking a climber's descent while rappelling.

In the art of mountain climbing it is frequently desireable for a climber to rappel, that is to move down a steep incline or overhang of a moutain suspended by a rope. In the fundamental rappelling operation the rope is supported from above the climber and wrapped around his body, usually under the left thigh and over the right shoulder. As the climber moves down the rope, playing it out with his hands, the rubbing of the rope against his body produces braking friction which tends to reduce the speed of his descent. However, it is often difficult for the climber to control his descent merely by wrapping the rope around his body and holding it with his hands. Moreover, the use of the climber's hands and body against the rope to brake his descent tends to cause injury to the climber due to the friction, and this tendancy limits the speed with which the climber may descent the mountain.

Other activities such as fighting fires and washing windows of tall buidings also frequently require a person to descend from a high place such as a building with a rope, and the aforementioned basic problems of rappelling arise in these activities as well. A number of devices have been designed for use in these activities to alleviate the problems encountered in descending by rope from a high place. Such devices are illustrated, for example, by Hobbs U.S. Pat. No. 3,678,543 showing a controlled personal descent device which utilizes a generally C-shaped hook and an enclosed-loop brake bar which slips over the hook to extend from side-to-side thereof, one end of the brake bar covering the opening on one side of the C-shaped hook. The hook is attached to the person by a ring and harness, and the supporting rope is threaded through a space defined by the brake bar and the top end of the hook, over the brake bar and back through a space defined by the brake bar and the bottom end of the hook. Alternatively, the rope may be wrapped in some other manner around the hook to further increase the friction surface between the hook and the rope. When longitudinal tension is placed upon the lower end of the rope, the friction produced by the rope's traveling through the hook and over the brake bar slows the descent of the person. Hobbs U.S. Pat. No. 3,757,901 discloses a similar, but more complicated, braking apparatus which includes a body member with two C-shaped portions each of which may be closed by a gate, and a C-shaped brake bar which slips over the body member extending from side-to-side thereof. Such specialized braking devices are not readily adaptable for use in mountain climbing because they may only be used effectively for the single limited purpose for which they were designed; therefore they would add weight to the climber's load which may not be efficiently utilized. Also, the safety of the device disclosed in U.S. Pat. No. 3,678,543 is limited since the hook does not form a fixed closed loop around the supporting rope, and while the gate of the device shown in U.S. Pat. No. 3,757,901 would reduce the likelihood of inadvertent release by providing such a fixed closed loop, the gate is relatively complicated to use and thus undesireable for the already difficult circumstances of mountain climbing.

In rappelling while mountain climbing braking is often accomplished utilizing a carabiner in combination with a brake bar attached thereto. The carabiner usually comprises an elongate closed loop made of strong, light metal having a circular cross-section with a swinging, spring-loaded gate formed in one side such that the carabiner may be rapidly attached and detached from various supporting implements. The brake bar typically comprises an elongate member having an aperture at each end, one of which is slotted from opening-to-opening, and the bar is attached to the carabiner such that it runs from side-to-side thereof, a portion of the loop of the carabiner being disposed in each of the apertures. One end of the carabiner is attached to the climber by some appropriate means, such as another carabiner attached to a loop of strong web-like material worn by the climber, and the suspending rope is threaded through this apparatus in a manner similar to the aforementioned prior art. As the mountain climber descends by the supporting rope he brakes and controls his descent by placing longitudinal tension on the portion of the rope below the carabiner to produce braking friction.

The use of a single carabiner and a brake bar by mountain climbers provides the advantages of efficient use of materials since a mountain climber typically carries a number of general purpose carabiners which are used for support and guiding ropes during climbing, thereby minimizing the weight carried, and safety since this arrangement is particularly adapted by its simplicity to the arduous circumstances of technical mountain climbing where errors may be very hazardous. On the other hand, the single carabiner utilized in this arrangement may break or come loose from the brake bar because this arrangement places a high transverse loading on the carabiner, which it was not designated to withstand, thereby presenting an extermely hazardous condition, and occasionally more braking friction is required than is readily provided by this apparatus.

SUMMARY OF THE INVENTION

The aforementioned drawbacks of prior art braking apparatus which either render them inappropriate for mountain climbing or limit their safety and braking effectiveness are overcome by the present invention which provides a novel braking apparatus utilizing a brake bar especially designed to accept two adjacent carabiners simultaneously.

The unique brake bar of the present invention has an elongate body defining oblong apertures at both ends thereof whose openings are long enough to accept two carabiners side-by-side but are limited in width to slightly more than the diameter of the circular cross-section of the loop of one carabiner. One aperture of the bar is slotted from opening-to-opening for insertion of the carabiners to attach them to the brake bar, and the slot faces inwardly toward the opposite end of the brade bar to enable the brade bar to wrap around the side of the carabiners placed in the slotted aperture thereby reducing the likelihood of their accidental release. The brake bar is thinner throughout its central portion than at its ends to accommodate the inwardly facing slot, the solid portion being biased toward one side thereof, and to reduce the weight of the brake bar. The other fully enclosed aperture includes a jog formed in the bar and directed inwardly toward the central portion thereof adjacent its solid side, which provides room for manipulating a first carabiner to facilitate the attachment of a subsequent carabiner to the brake bar after the first one has been attached.

The use of two carabiners is particularly advantageous in that the resulting greater strength reduces the likelihood of failure of the braking apparatus, the redundancy prevents a hazardous condition from resulting in the event that one carabiner accidentally releases, and the greater thickness of the brake bar-carabiner combination increases the deflection of the rope and therefore the resultant braking friction produced by the apparatus. Moreover, the unique shape of the brake bar tends to prevent accidental release of the carabiners and to facilitate their attachment thereto.

It is therefore a principle objective of this invention to provide a novel and improved apparatus and method for braking a climber's descent while rappelling during mountian climbing.

It is another object to provide such an apparatus and method which utilizes two carabiners attached to a brake bar for increased safety and braking effectiveness.

It is a principle feature of the present invention that it utilizes a brake bar having oblong apertures at both ends which each accept two carabiners placed therein side-by-side.

It is another feature of the present invention that one aperture of the aforementioned brake bar includes an inwardly facing slot running from opening-to-opening for insertion of the carabiners and shaped to reduce the likelihood of their release, and the other aperture is provided with a strategically placed inward jog toward the center of the brake bar to facilitate attachment of a second carabiner once the first one is attached.

It is a further feature of this invention to provide a brake bar with a relatively narrow central portion to reduce its weight and accommodate the aforementioned inwardly facing slot, and rounded edges along one side of the central portion to provide a smooth surface against which a supporting rope may rub.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
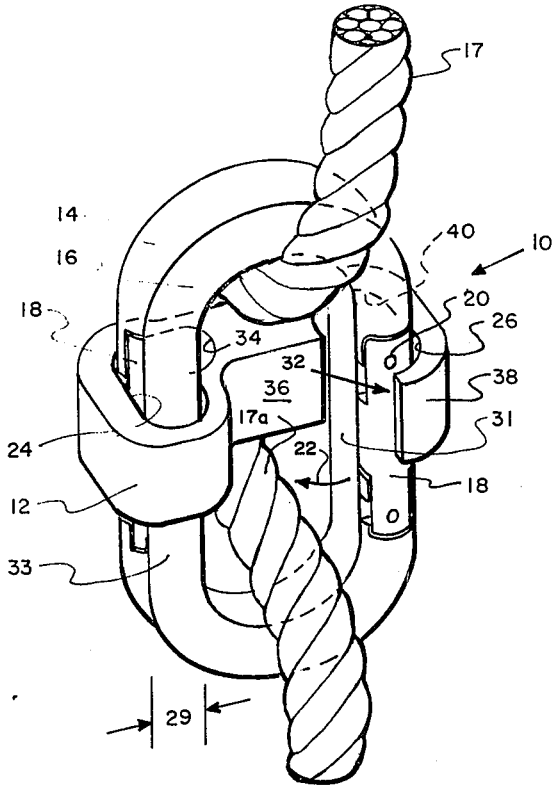
FIG. 1 is a perspective view of a braking apparatus according to the present invention, showing an exemplary supporting rope threaded therethrough.

Referring to FIG. 1, the braking apparatus 10 and method of the present invention utilize a brake bar 12 to which a first carabiner 14 and a second carabiner 16 are attached adjacent one another. The two carabiners are attached to a mountain climber, for example by another carabiner to a loop of the climber's web gear, and a supporting rope 17 is threaded through an opening defined by the brake bar and one end of the adjacent carabiners, over the brake bar and back through an opening defined by the brake bar and the other end of the carabiners.

Each of the carabiners is of a standard design utilizing a lightweight, strong material, ordinarily having a circular cross-section, which is shaped in the form of an elongate loop. Each loop includes a gate 18 which is hinged at point 20 so that it will swing inwardly toward the center of the loop as shown by the arrow 22. The gates are spring biased closed, and cannot swing outwardly from the loop.

Figure 2:
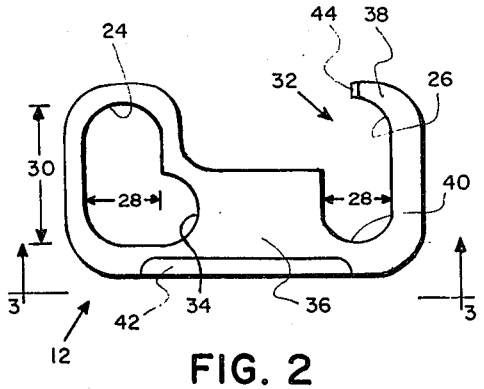
FIG. 2 is a bottom view of a brake bar portion of the aforementioned braking apparatus.

Turning now to FIG. 2 as well as FIG. 1 the brake bar 12 comprises an elongate body member which defines an oblong enclosed aperture 24 at one end and a second oblong slotted aperture 26 at the other. The width 28 of each aperture is slightly larger than the diameter 29 of the circular loop material which forms a carabiner to receive a portion of the loop therein, and the length 30 of each aperture is just large enough to receive two carabiners therein side-by-side.

The first carabiner 14 is attached to the brake bar by opening its gate 18, placing one end of its loop on the open side thereof through the enclosed aperture 24 and releasing the gate. The second carabiner 16 may then be attached by opening its gate, placing an end of the open side of its loop through the enclosed aperture 24, feeding the loop through the aperture 24 until the carabiner 16 is oriented laterally opposite the carabiner 14 in the longitudinal dimension of the brake bar with its fixed side 33 placed in aperture 24. Thereafter the carabiners are attached to the mountain climber, and the bight 17*a* of the supporting rope is pulled first through the carabiner 16 then through the carabiner 14 and placed over the brake bar 12. Next, the slotted-aperture end of the brake bar is snapped over the two carabiners by placing the fixed side 31 of the carabiner 14 and the gate 18 of the carabiner 16 through a slot 32 in the slotted aperture 26, resulting in the assembled apparatus as shown in FIG. 1. Of course any reasonable manipulation of the carabiners to attach them to the brade bar 12 in the manner shown in FIG. 1, to the rope and to the climber might be used. Also, while the orientation of the two carabiners as shown in FIG. 1 is preferred since it most effectively prevents side-to-side movement of the two carabiners, the apparatus might be used with the orientations of the two carabiners reversed, but they should at least be oriented laterally opposite to one another in the longitudinal dimension of the brake bar to prevent their simultaneous accidental release.

Figure 3:
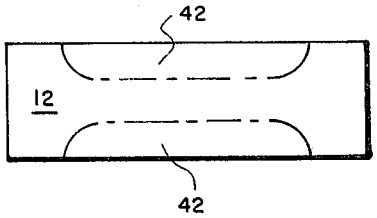
FIG. 3 is a side view of the aforementioned brake bar taken along line 3—3 of FIG. 2.

Referring to FIGS. 2 and 3, the unique shape of the brake bar 12 is particularly adapted to the use of two carabiners in a braking apparatus for mountain climbing. While the shape of the brake bar might be slightly modified to accept more than two carabiners without departing from the principles of this invention, the use of only two is preferred for the sake of simplicity since two is believed to be adquate. A central portion 36 of the brake bar is considerably narrower than the ends since this provides sufficient strength while minimizing the weight of the brake bar. This also permits the slot 32 to open toward the inside of the brake bar such that a wall 38 will wrap around the second carabiner 16 thereby preventing it from rotating outwardly to the side and thus tending to prevent it from accidently releasing. At the same time the central portion 36 is broad enough to permit the formation of an inward jog 34 for facilitating attachment of the second carabiner by providing additional room for manipulating the previously-attached first carabiner 14, and it enables the formation of a U-shaped pocket 40 in the slotted aperture which constrains the first carabiner 14 from moving from side-to-side once the second carabiner has been attached. The edges 42 of the brake bar are rounded to provide a smooth constant surface over which the supporting rope may move thereby increasing the frictional surface area of the apparatus and eliminating sharp edges which would otherwise cut into the rope. Also, the corners 44 of the brake bar are rounded further to prevent damage to the rope or injury to the climber.

In using the braking apparatus of the present invention the climber places longitudinal tension on the end of the rope below the apparatus, usually by permitting the rope to rub against his body, thereby binding the rope against the brake bar and ends of the carabiners which produces braking friction and places stress upon the parts of the apparatus. The unique method for braking while rappelling provided by the present invention utilizes two carabiners in adjacent relationship to increase the effective strength of the braking apparatus to resist such stress, and to provide redundancy in the event that one carabiner should accidentally release. Moreover the use of two adjacent carabiners increases the deflection of the supporting rope thereby increasing the friction generated by the braking apparatus, which gives the climber greater control of his descent.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A braking apparatus for use in rappelling, comprising an elongate brake bar body member defining a pair of apertures extending respectively through each end thereof in a direction substantially perpendicular to the longitudinal axis of said body member, each said aperture having two open ends, and a plurality of carabiners removably attached to said body member adjacent one another so that a portion of the loop of each carabiner is disposed within each said aperture, said body member including a slot formed therein extending between the two open ends of one said aperture for receiving said carabiners, said slot defining a gap in a portion of said body member which forms said one aperture, and said other aperture of said body member including a jog formed in said body member and directed toward the center thereof for facilitating the attachment of a subsequent one of said plurality of carabiners after a first of said carabiners has been attached to said body member.

2. A brake bar for simultaneous attachment of a plurality of carabiners thereto, comprising an elongate body member defining a pair of oblong apertures extending respectively through each end thereof in a direction substantially perpendicular to the longitudinal axis of said body member, each said aperture having two open ends and the longest diameter of each said aperture being oriented substantially perpendicular to said longitudinal axis of said body member, said bar member including a slot formed therein extending between the two open ends of one said aperture, said other aperture being fully enclosed and including a jog formed in said body member and directed toward the center of said body member for facilitating the attachment of a subsequent one of said plurality of carabiners after a first one of said carabiners has been attached to said brake bar.

3. A brake bar for simultaneous attachment of a plurality of carabiners thereto, comprising an elongate rigid body member defining a pair of oblong apertures extending respectively through each end thereof in a direction substantially perpendicular to the longitudinal axis of said body member, each said aperture having two open ends and the longest diameter of each said aperature being oriented substantially perpendicular to said longitudinal axis of said body member, said body member including a slot formed therein defined by two edges extending between the two open ends of one of said aperture thereby forming an open gap in a portion of said body member which forms said one aperture, said other aperture being fully enclosed, a central portion of said body member extending from side to side thereof between said apertures and being recessed in a direction perpendicular to the direction of extension of said apertures through said body member so that said central portion is relatively narrower than the rest of said body member thereby defining a space along one side thereof, and said portion of said body member forming said one aperture having a wall portion extending from the end of said body member adjacent said one aperture toward the opposite end of said body member on the recessed side thereof, and terminating at one edge of said slot located at a position spaced away from said central portion of said body member in a direction opposite the direction of the recession of the central portion, the other edge of said slot being formed by that part of the central portion of said body member located at the junction of said one aperture and said space, said slot opening into said space.

4. The brake bar of claim 3 wherein the outside edges opposite said recessed side of said central portion of said body member are rounded to provide a smooth surface over which a rope may move.

5. A braking apparatus for use in rappelling, comprising an elongate rigid brake bar body member defining a pair of apertures extending respectively through each end thereof in a direction substantially perpendicular to the longitudinal axis of said bar member, a plurality of carabiners removably attached to said body member adjacent one another such that a portion of the loop of each carabiner is disposed within each said aperture, each said carabiner having a hinged gate formed in one side of the loop thereof with two of said carabiners being oriented with their respective gates adjacent opposite ends of said brake bar, and means for retaining said carabiners in said apertures of said body member such that they may be removed only by opening said gates.

* * * * *

UNITED STATES PATENT AND TRADEMARK OFFICE

CERTIFICATE OF CORRECTION

PATENT NO. : 4,019,609

DATED : April 26, 1977

INVENTOR(S) : Kelly B. Wagner

It is certified that error appears in the above-identified patent and that said Letters Patent are hereby corrected as shown below:

| | | |
|---|---|---|
| Col. 1, | line 11 | Change "moutain" to --mountain--; |
| | line 25 | Change" descent" to --descend--; |
| | line 27 | Change "buidings" to --buildings--. |
| Col. 2, | line 38 | Change "designated" to --designed--; |
| | line 39 | Change "extermely" to --extremely--; |
| | line 60 | Change "brade" to --brake-- (both occurrences). |
| Col. 3, | line 20 | Change "object" to --objective--. |
| Col. 4, | line 38 | Change "brade" to --brake--. |

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*